US005282500A

United States Patent [19]

Tanaka et al.

[11] Patent Number: 5,282,500

[45] Date of Patent: Feb. 1, 1994

[54] CONTAINER FILLING APPARATUS

[75] Inventors: Yoshiharu Tanaka; Masayuki Hayashi; Hiroyuki Takagawa; Katsuhiko Kondo; Yukio Yamaguchi, all of Nagoya, Japan

[73] Assignee: Mitsubishi Jukogyo Kabushiki Kaisha, Tokyo, Japan

[21] Appl. No.: 801,516

[22] Filed: Dec. 2, 1991

[30] Foreign Application Priority Data

Nov. 30, 1990 [JP] Japan ..... 2-336575
Aug. 6, 1991 [JP] Japan ..... 3-196670

[51] Int. Cl.[5] ..... B67C 3/04

[52] U.S. Cl. ..... 141/301; 141/45; 141/147; 141/308

[58] Field of Search ..... 141/6, 39, 40, 44–46, 141/144–147, 152, 177, 181, 182, 251, 255, 258–261, 263, 264, 266, 284, 290–296, 301–303, 308

[56] References Cited

U.S. PATENT DOCUMENTS 1,371,244 3/1921 Huntley ..... 141/301 X
2,592,846 4/1952 Ayars ..... 141/147 X
2,628,759 2/1953 Bodendoerfer ..... 141/293
2,676,742 4/1954 Day et al. ..... 141/39
2,746,663 5/1956 Day et al. .
2,761,607 9/1956 Ayars ..... 141/147
2,913,016 11/1959 Luther ..... 141/147 X
3,605,827 9/1971 Risser ..... 141/46 X
5,139,058 8/1992 Yun ..... 141/40

FOREIGN PATENT DOCUMENTS 2126870 10/1972 France .
2164014 7/1973 France .
2580616 10/1986 France .

*Primary Examiner*—J. Casimer Jacyna
*Attorney, Agent, or Firm*—Wenderoth, Lind & Ponack

[57] ABSTRACT

A container filling apparatus makes it possible to discharge liquid stagnating within a filling valve. The filling valve is lowered towards a container being conveyed. Then a liquid passageway gating section is opened by pressing a bell-shaped member of the filling valve against the container, and liquid thus fills the container. The net amount of the contents to fill the container can be adjusted by vertically moving at least one of a filler liquid tank and a stopper member which limits the lower position of an intermediate spring bracket supporting a second elastic body for biasing a valve body upwardly with respect to a loading table on which the containers are supported. In addition, it is possible to open the liquid passageway gating section by lowering the filling valve with an external force. Therefore, liquid stagnating in the passageway of the filling valve can be discharged.

6 Claims, 10 Drawing Sheets 156
157
132
101
104
108
221
220
225
223
140
134
144
138
180
α

CONTAINER FILLING APPARATUS

BACKGROUND OF THE INVENTION

1. Field of the Invention

The present invention relates to a container filling apparatus for filling a container with liquid.

2. Description of the Prior Art

A method and an apparatus for filling an empty container have been heretofore described in Japanese Utility Model Publication No. 58-15359 (1983). With this apparatus, the net amount of the contents can be adjusted by manipulation of a presser nut and a pad presser provided at an end portion of a liquid pouring pipe through which the liquid flows into the container.

Also, a prior art container filling apparatus has been disclosed in Japanese Utility Model Publication No. 60-145 (1985).

In this container filling apparatus, while containers are conveyed in a horizontal direction, a filling valve is lowered and pressed against a container, and liquid is poured into the container by opening a liquid passageway gating section.

However, the former apparatus is subject to the following problems. That is, when filling containers at a high speed, a large number of filling apparatuses are arranged in a ring. Consequently, when changing the net amount of the contents in the case where a different type of container is introduced to the line, it is necessary to manipulate the pressure nut and pad presser of all of the filling apparatuses. The operational efficiency is poor due to such adjusting work.

Also, although the latter container filling apparatus in the prior art lowers a filling valve against a container while containers are conveyed horizontally, and causes a liquid passageway gating section to open so that liquid fills the container, the apparatus does not include a mechanism by which stagnating liquid can be drained from the apparatus.

SUMMARY OF THE INVENTION

It is therefore one object of the present invention to provide an improved container filling apparatus, in which the above-described disadvantages in the prior art are eliminated.

A first embodiment of a container filling apparatus of the present invention comprises: a hollow housing communicating with a filler liquid tank and fixedly secured to the bottom of the filler liquid tank; a vent tube extending within the housing; a valve body mounted so as to be movable with respect to the housing, having a passageway therein through which the liquid in the filler liquid tank flows, and fixedly secured to the vent tube; a liquid valve seat connected to the valve body via a first elastic body, mounted so as to be movable with respect to the valve body, forming a filler liquid flow passage with the outer surface of the vent tube, and butting against an end portion of the vent tube to form a gating valve; a bell-shaped member engaged with the liquid valve seat via a third elastic body, mounted movably to the liquid valve, and having a container seal member which seals a gap between the liquid valve and the bell-shaped member; an intermediate spring bracket supporting a second elastic body for biasing the valve body upwards; elevator means capable of elevating, lowering and downwardly biasing the valve body; a stopper member for limiting the movement of the intermediate spring bracket; and driving means capable of vertically moving at least one of the filler liquid tank and the stopper member with respect to a loading table on which the containers are supported.

A second embodiment of a container filling apparatus of the invention comprises: a hollow housing communicating with a filler liquid tank and fixedly secured to the bottom of the filler liquid tank; a vent tube extending within the housing; a valve boy mounted so as to be movable with respect to the housing, having a passageway therein through which the liquid in the filler liquid tank flows, and fixedly secured to the vent tube; a liquid valve seat connected to the valve body via a fist elastic body, mounted so as to be movable with respect to the valve body, forming a filler liquid flow passageway with the outer surface of the vent tube, and butting against an end portion of the vent tube to form a gating valve; a bell-shaped member connected to the liquid valve seat via a third elastic body, movably mounted to the liquid valve, and having a container seal member which seals a gap between the liquid valve and the bell-shaped member; an intermediate spring bracket supporting a second elastic body for biasing the valve body upwards; elevator means capable of elevating, lowering and downwardly biasing the valve body; a stopper member for limiting the movement of the intermediate spring bracket; a fourth elastic body for downwardly biasing the valve body; a float mounted to the bottom portion of the fourth elastic body; and a float stopper member for establishing a lowermost position of the float; at least one of the filler liquid tank and the stopper member being vertically movable with respect to a loading table on which the containers are supported.

According to the first embodiment of the invention when a container is not present on the loading table, the vent tube is biased downwards via the valve body by a downward biasing force exerted through the elevator means. On the other hand, the liquid valve seat is moved with respect to the valve body via the first elastic body and butts against an end portion of the vent tube, and thus the gating valve is closed. When the arm member is raised, the liquid valve seat initially butts against the intermediate spring bracket, and thereafter rises jointly with the intermediate spring bracket. In addition, even after the liquid valve seat has butted against the intermediate spring bracket, the liquid valve seal is biased downwardly by the sum of the resilient forces of the first elastic body and the second elastic body. Hence, the liquid valve seat butts against the end portion of the vent tube, and the gating valve is held in closed.

On the contrary, when an empty container is present on the loading table, and the arm member is lowered, because the intermediate spring bracket butts against the stopper member and is prevented from being lowered, the resilient force of the second elastic body does not act to the liquid valve seat, and the liquid valve seat does not move in the downward direction. On the other hand, because the vent tube moves in the downward direction, it is disengaged from the liquid valve seat, and the gating valve assumes an opened condition. As a result, the filler liquid in the filler liquid tank flows into the container through the housing, the passageway and the filler liquid flow passageway.

The net amount of contents to fill the container is adjusted by means of the driving device which can vertically move at least one of the filler liquid tank and the stopper member. In other words, the adjustment is effected by changing the positional relationship between the top of the container and the bottom of the liquid valve seat by way of changing the position of the stopper member or the filler liquid tank with respect to the loading table.

According to the second embodiment of the invention, when a container is not present on the loading table, the vent tube is biased downwards via the valve body by a downward biasing action exerted through the elevator means. On the other hand, the liquid valve seat is moved with respect to the valve body via the first elastic body and butts against an end portion of the vent tube. Thus, the gating valve is closed. When the arm member is raised, the liquid valve seat initially butts against the intermediate spring bracket, and thereafter rises with the intermediate spring bracket. In addition, even after the liquid valve seat has butted against the intermediate spring bracket, the liquid valve seat is biased downwardly by the sum of the resilient forces of the first elastic body and the second elastic body. Hence, the liquid valve seat butts against an end portion of the vent tube, and the gating valve is held closed.

On the contrary, when an empty container is present on the loading table, and the arm member is lowered, because the intermediate spring bracket butts against the stopper member and is prevented from lowering, the resilient force of the second elastic body does not act to the liquid valve seat and the liquid valve does not move in the downward direction. On the other hand, because the vent tube moves in the downward direction, it is disengaged from the liquid valve seat, and the gating valve assumes an opened condition. As a result, the filler liquid in the filler liquid tank flows into the container through the inside of the housing, the passageway, and the filler liquid flow passageway.

In addition, liquid stagnating within the valve body can be drained by opening the liquid passageway gating section with an external force. At first, under a free condition where an external force does not act upon the filling valve, the valve body is subjected to an upward force by the second elastic body, and is also subjected to a downward force by the fourth elastic body. The downward force exerted by the fourth elastic body is larger than the upward force exerted by the second elastic body. Thus, the valve body is held still with the float connected to the bottom of the fourth elastic body butting against the float stopper member. Under this condition, the stopper member is not held in contact with a central flange of the liquid valve sat which is urged downwards by the first elastic body. Consequently, the liquid passageway gating section is held closed by the action of the first elastic body.

Next, an external force, larger than the upward force exerted upon the valve body by the second elastic body, is applied in the downward direction to the valve body. Then, the valve body moves downward. Hence, the central flange of the liquid valve butts against the stopper member, and if the valve body is allowed to descend further, the vent tube fixedly secured to the valve body descends with respect to the liquid valve. Therefore, the gating section is opened, and liquid stagnating in the liquid passageway is discharged.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENTS

Figure 1:
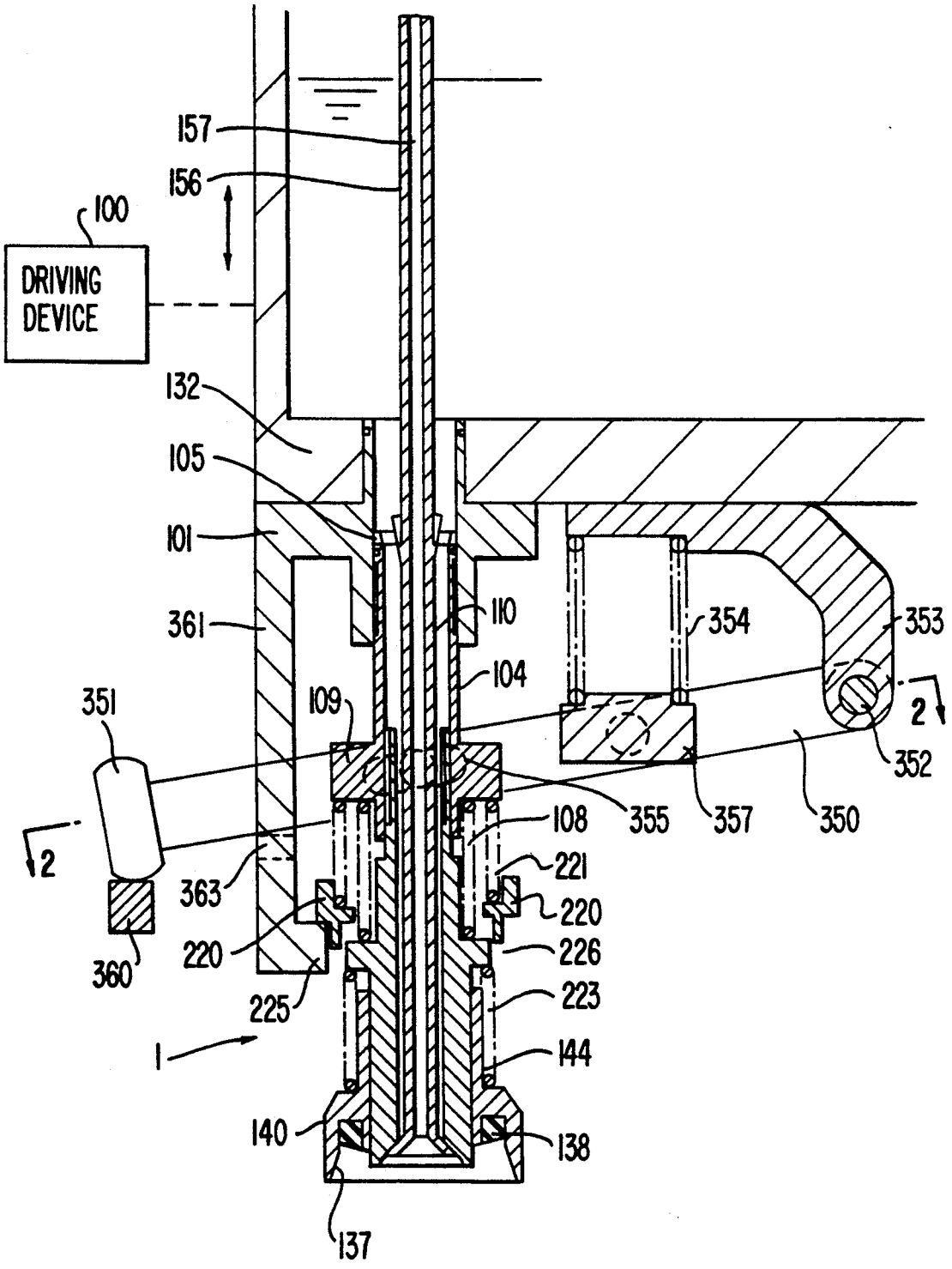
FIG. 1 is a vertical cross-sectional view of a first preferred embodiment of a container filling apparatus according to the present invention.

Now, a number of preferred embodiments of the present invention will be described with reference to the accompanying drawings. FIG. 1 shows one of a plurality of filling apparatus which are arranged in a ring. A hollow housing 101 is fixedly secured by bolts (not shown) to the bottom of an annular filler liquid tank 132 provided with a driving device 100 so that it can be vertically moved with respect to a loading table. The above-mentioned driving device comprises well-known drive means such as a rack and pinion mechanism, a screw mechanism or the like. The driving device 100 is schematically illustrated in FIG. 1 with the vertical movement of the tank 132 and/or stopper member 225 (described later) represented by the double-headed arrow. At the center of the housing 101 is a vent tube 156 defining a discharge path therein. The vent tube 156 has one end projecting up to a gas layer in the filler liquid tank 132, and another end forming a tapered opening and butting against a liquid valve seat 144. The end of the vent tube 156 and valve seat 144 form a gating valve for filling the container with liquid. A hollow valve body 104 is coaxial with the housing 101, and is movable with respect to the housing 101 while air-tightness is maintained therebetween. In this particular embodiment the valve body 104 is slidably fitted to an internal portion of the housing, although the valve body can be fitted either externally or internally of the housing. The other end portion of the valve body forms a flange 109 engaging an elastic body 108 as will be described later. It is to be noted that in the case where the gas pressure in the filler liquid tank 132 is negative, a seal between the housing 101 nd the valve body 104 is provided to prevent leakage under the particular negative pressure. The valve body 104 is fixedly secured to the vent tube 156 to form an integral body. It is to be noted that the valve body 104 has a liquid passageway 105 extending therethrough so that liquid in the filler liquid tank can flow via the hollow housing 101 into a filler liquid passageway 110 formed between an outer surface of the vent tube 156 and the valve body 104.

In order for the valve body 104 to be vertically movable with respect to the housing 101, the valve body 104 is connected to a pair of arm members 350 via a pin 136 which is slidably received in elongate holes 355 formed in the arm members 350. The pin 136 and holes 355 serves as a coupling member. The hollow liquid valve seat 144 is movable with respect to the valve body 104 while air-tightness is maintained therebetween. The valve seal 144 can be fitted either externally or internally to the valve body 104, although in this particular embodiment it is slidably fitted internally, i.e. to an internal portion of the valve body 104. A first elastic body 108 is interposed between a flange 109 of the valve body 104 and a central flange 226 of the liquid valve seat 144. It is to be noted that in the case of a vacuum filling machine in which the gas pressure in the filler liquid tank 132 is negative, a seal is established to such a degree between the valve body 104 and the liquid valve 144 that leakage will not occur under the particular negative pressure. In addition, a second elastic body 221 is mounted between the flange 109 and an intermediate spring bracket 220 which is annular and has its inner circumferential surface guided while in contact with an outer circumferential surface of the central flange 226 of the liquid valve 144. A stopper member 225 limits downward movement of the spring bracket 220. It is to be noted that the resilient force of the second elastic body 221 could be received by the housing 101 or the arm members 350 instead of being received by the flange 109. Also, although the stopper member 225 could be vertically driven by a driving device, in this preferred embodiment the stopper member 225 is merely fixedly secured to a guide 361 of the housing 101 mounted to the filler liquid tank 132 that is vertically movable. To the outer circumferential portion of the liquid valve seat 144 is slidably fitted a bell-shaped member 140. A third elastic body 223 extends between bell-shaped member 140 and flange 226. In addition, the liquid valve seat 144 is mounted so as to be able to butt against the intermediate spring bracket 220. It is to be noted that the bell-shaped member 140 has a frustoconical surface 137 which defines a passage becoming more narrow in an upward direction from a bottom end of the member 140 so that a container can be easily inserted in the member 140. At the inner end portion of this frustoconical surface 137 is disposed a seal member 138. It is to be noted that containers 134 (See FIG. 3) are placed on a horizontal loading table (not shown) which is fixed with respect to a filling machine main body, and are constrained by a semi-circular guide section so as to be centered with respect to the filling apparatus 1.

Figure 2:
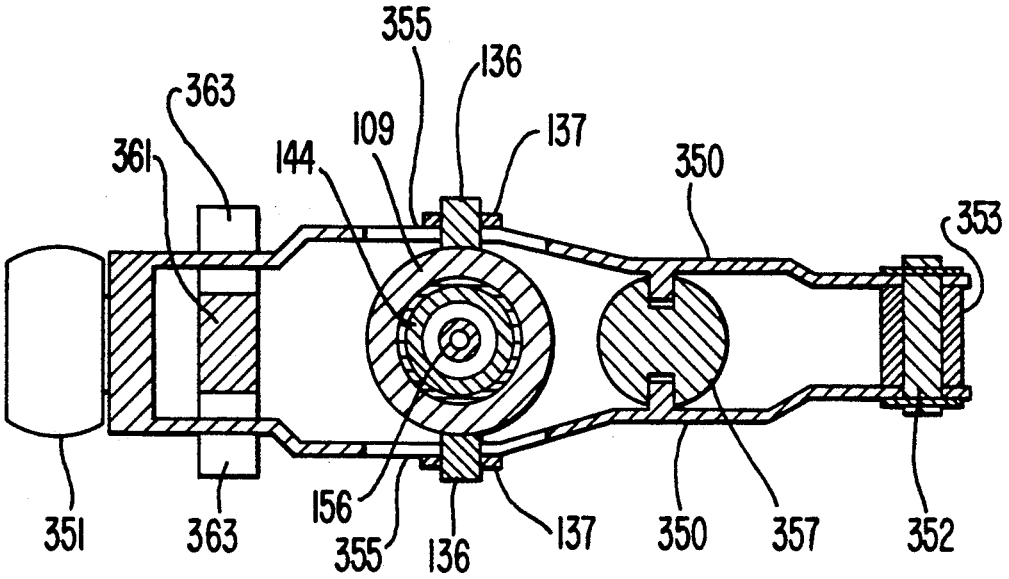
FIG. 2 is a horizontal cross-sectional view of an arm member of the same preferred embodiment taken along line 2—2 in FIG. 1.

Next, the structure for vertically moving the valve body 104 will be further described with reference to FIG. 2. The arm members 350 are provided with a roller 351 at one end thereof and with a pin 352 at the other end thereof. The pin 352 is rotatably supported by a support arm 353 fixedly secured by bolts to the bottom surface of the filler liquid tank 132. It is to be noted that the pin 136 has rotary lock plates 137 for preventing rotation of the valve body 10 fixed thereto.

Located between the elongate holes 355 of the arm members 350 and the pin 352 is an elastic body 354 (FIG. 1) for biasing the arm members 350. The elastic body 354 is interposed between the arm members 350 and the support arm 353, and the bottom end of the elastic body 354 is supported via a washer 357 on the arm members 350. On the other hand, the guide 361 hanging from the housing 101 is disposed at a position between the elongate hole 355 of the arm member 350 and the roller 351. The bottom end portion of this guide 361 forms a stopper member 363 for limiting the lowering of the arm member 350. In addition, as shown in FIG. 1, a control cam 360 is adapted to butt against the roller 351 for vertically moving the valve body 104 via the arm members 350.

Next, the operation of the above-described apparatus will be described with reference to FIGS. 3 to 8. Containers 134 are conveyed while being held at a fixed level, and filling is effected sequentially in the direction indicated by arrow B. At position ① in FIG. 3, filling has been completed, and a valve body 104 and a vent tube 156 are about to be raised under the action of the roller 351 rolling along the control cam 360. At position ② the valve body 104 has been raised to an uppermost position thereof by the roller 351 rolling along the control cam 360, and the container 134 is ejected. At position ③ a container 134 fed externally of the filling apparatus is ready to be filled with liquid, and the valve body 104 is moving downwards as controlled by the control cam 360 and the roller 351.

Figures 4, 5, 6, 7, 8:
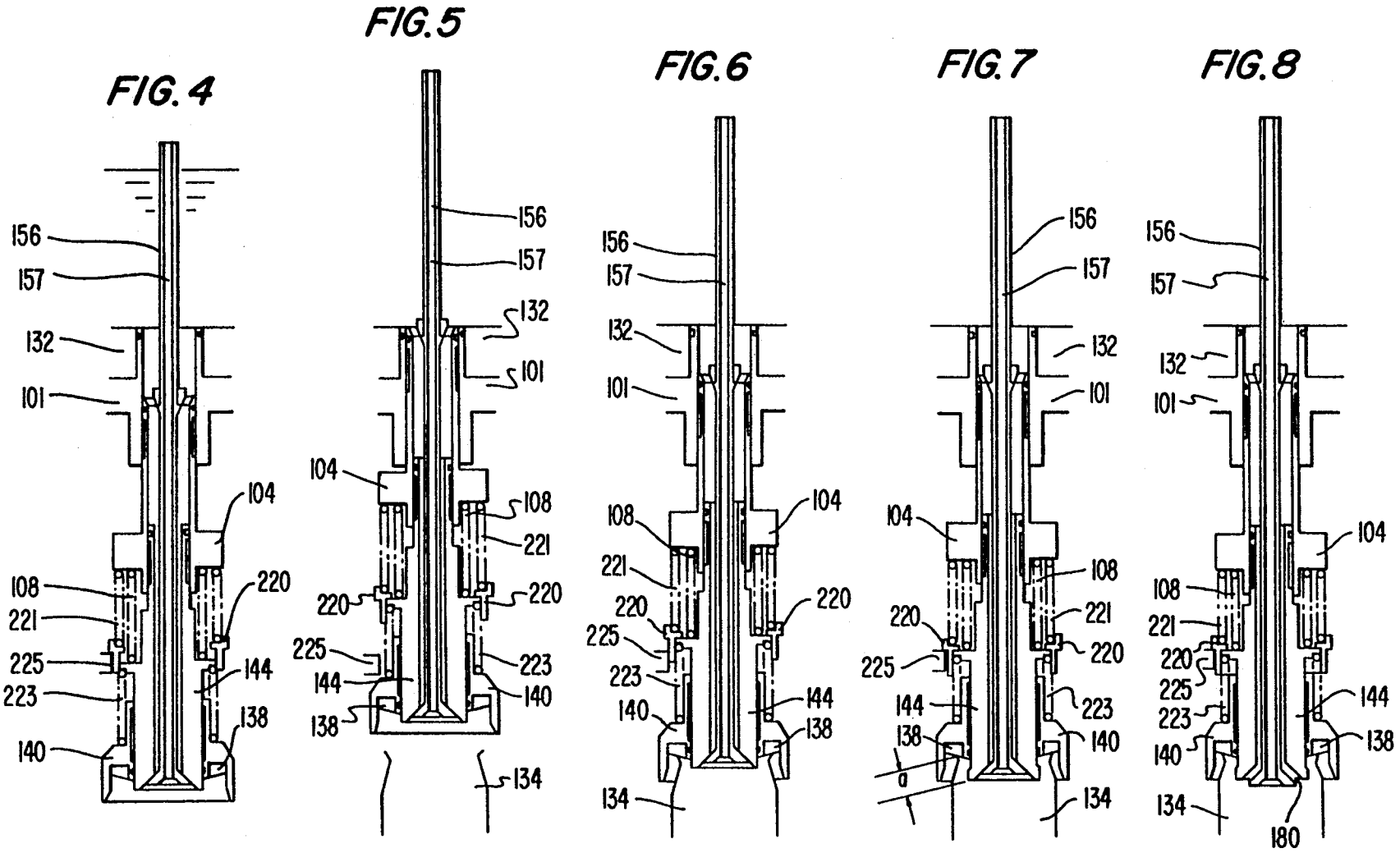
FIGS. 4 to 8 are schematic cross-sectional views of the container filling apparatus illustrating successive steps carried out by the container filling process.

FIG. 4 shows a state where a container 134 is not present and arm members 350 omitted from the illustration have been lowered, that is, the arm members 350 are butting against the stopper member 363. In this state, the arm members 350 have been lowered to a maximum extent, the elastic body 354 is expanded, and the vent tube 156 has been lowered jointly with the lowering of the arm members 350. On the other hand, the liquid valve 144 is biased downwards by the first elastic body 108. Hence, the liquid valve 144 butts against the end portion of the vent tube 156, and the so-called gating valve is held in a closed condition.

FIG. 5 shows a state in which the arm members 350 are raised. When the apparatus shifts from the state shown in FIG. 4 to the state shown in FIG. 5, as the arm members 350 rise the liquid valve seat 144 initially butts against the intermediate spring bracket 220, and thereafter the arm members 350 and liquid valve seat 144 rise jointly with the intermediate spring bracket 220. Even after the liquid valve seat 144 has butted against the intermediate spring bracket 220, the liquid valve seat 144 is biased downwardly by the sum of the resilient forces of the first elastic body 108 and the second elastic body 221, and the gating valve is held in a closed condition in which the liquid valve seat 144 butts against the end portion of the vent tube 156.

Next, FIG. 6 shows a state at the moment when the arm members 350 are being lowered and the container 134 has butted against the seal member 138. It is to be noted that at this time the gating valve is also held in a closed condition by the sum of the resilient forces of the first elastic body 108 and the second elastic body 221.

FIG. 7 shows a state at the moment when the arm members 350 are being lowered and the intermediate spring bracket 220 has butted against the stopper member 225. During the period when the apparatus shifts from the state shown in FIG. 6 to the state shown in FIG. 7, since the sum of the resilient forces of the first elastic body 108 and the second elastic body 221 is larger than the resilient force of the third elastic body 223, the liquid valve seat 144 is urged against the end portion of the vent tube 156, whereby a closed condition of the gating valve is maintained. And, the valve body 104, the vent tube 156 and the liquid valve seat 144 are integrated and move together downwardly relative to the bell-shaped member 140 which is prevented from moving downward by the container 134, whereby the third elastic body 223 is compressed. Starting from the state shown in FIG. 7, if the arm members 350 are further lowered, since the intermediate spring bracket 220 is prevented from lowering while butting against the stopper member 225, the resilient force of the second elastic body 221 does not act to lower the liquid valve seat 144. At this time, since the resilient force of the third elastic body 223 is larger than the resilient force of the first elastic body 108, the liquid valve seat 144 stops moving downwards. On the other hand, since the vent tube moves downwards, it is disengaged from the liquid valve seat 144. Hence, a gap 180 is produced, and the valve assumes an open condition. The lowering of the arm members cease when the arm members 350 have butted against the stopper member 363, and the apparatus takes the state shown in FIG. 8. As a result, the liquid within the filler liquid tank 132 flows through the passageway 105 and the liquid passageway 110 into the container 134. On the other hand, air within the container 134 is discharged to the gas layer of the filler liquid tank 132 through the discharge path 157 formed in the vent tube 156. Thus, the container can be filled with a predetermined amount of liquid. It is to be noted that the resilient force of the elastic body 354 is larger than the sum of the resilient forces of the second elastic body 221 and the third elastic body 223, and so, even in the event that a container 134 is present, the arm members 350 can be lowered to a position where they butt against the stopper 363.

Figure 3:
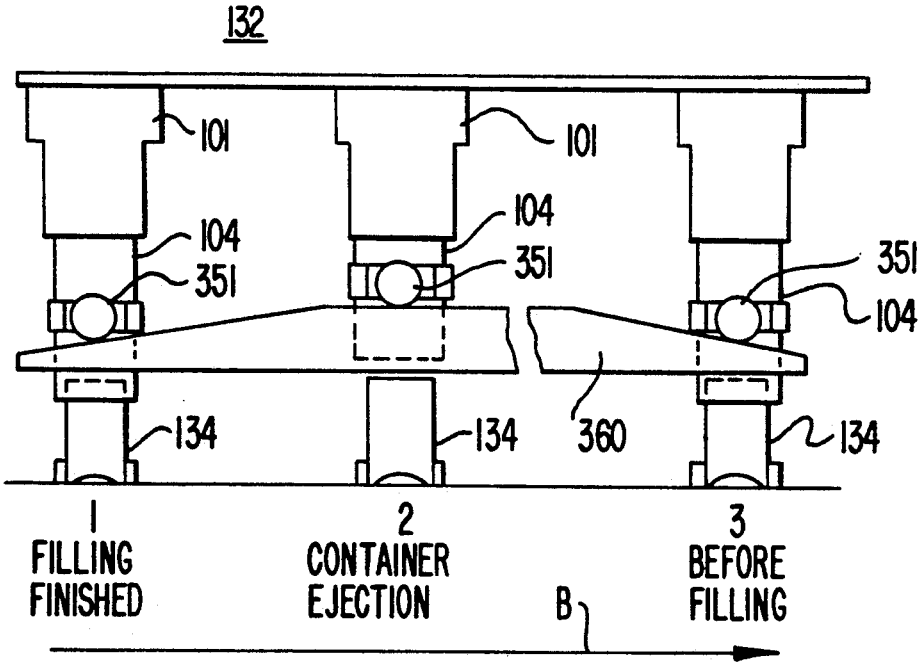
FIG. 3 is a schematic view showing successive filling steps carried out by the container filling apparatus of the present invention.

Next, starting from the position ① shown in FIG. 3, the arm members 350 are raised by the control cam 360 and the roller 351. Accompanying this rising motion, the valve body 104 as well as the vent tube 156 connected to the valve body 104 rise. However, because of the fact that the resilient force of the third elastic body 223 is larger than the resilient force of the first elastic body 108, the intermediate spring bracket 220, the liquid valve seat 144 and the bell-shaped member 140 do not move. The tip end portion of the vent tube 156 then butts against the liquid valve seat 144, and the apparatus returns to the state shown in FIG. 7, wherein the gating valve assumes a closed condition. If the arm members 350 rise further, the intermediate spring bracket 220, the liquid valve seat 144 and the vent tube 156 move together in the upward direction because of the fact that the sum of the resilient forces of the first elastic body 108 and the second elastic body 22 is larger than the resilient force of the third elastic body 223. At this time, the liquid valve seat 144 rises with respect to the bell-shaped member 140, and after the seal member 138 is disengaged from the container 134 (FIG. 6), assumes the position ② shown in FIG. 3, that is, the state shown in FIG. 5.

Next, as shown in FIG. 7 a net content depth is established by the bottom end position of the liquid valve seat 144 and the position of the container 134 butting against the seal member 138 (dimension a in FIG. 7). More particularly, when liquid is poured into the container 134 while air within the container 134 is discharged through the vent tue 156 into a gas layer in the filler liquid tank 132, because the air in the portion of the dimension a shown in FIG. 7 cannot escape, the above-mentioned dimension a determines the net content depth. Accordingly, to change the dimension a, i.e. to vary the net content depth, it is only necessary to replace the seal member 138 with one of a different thickness, to change the height of the filler liquid tank 132 which sets the lowermost position of the bottom end of the liquid valve seat 144, to change the position of the stopper member 225 relative to the vertical, or to change the height of the loading table which sets the position of the top ends of the containers 134. In order to change the seal members 138, it is necessary to work on each of the filling apparatuses (gating valves) arranged in a ring, as is the case with the prior art. Therefore, in this particular embodiment of the present invention, instead of changing the above-mentioned seal members 138, the driving device 100 for vertically moving the filler liquid tank 132 is operated so that adjustment of the net content depth can be effected easily. Alternatively, a spacer is used to change the effective position of the stopper member 225 relative to the vertical, whereby a similar effect is achieved.

Figure 9:
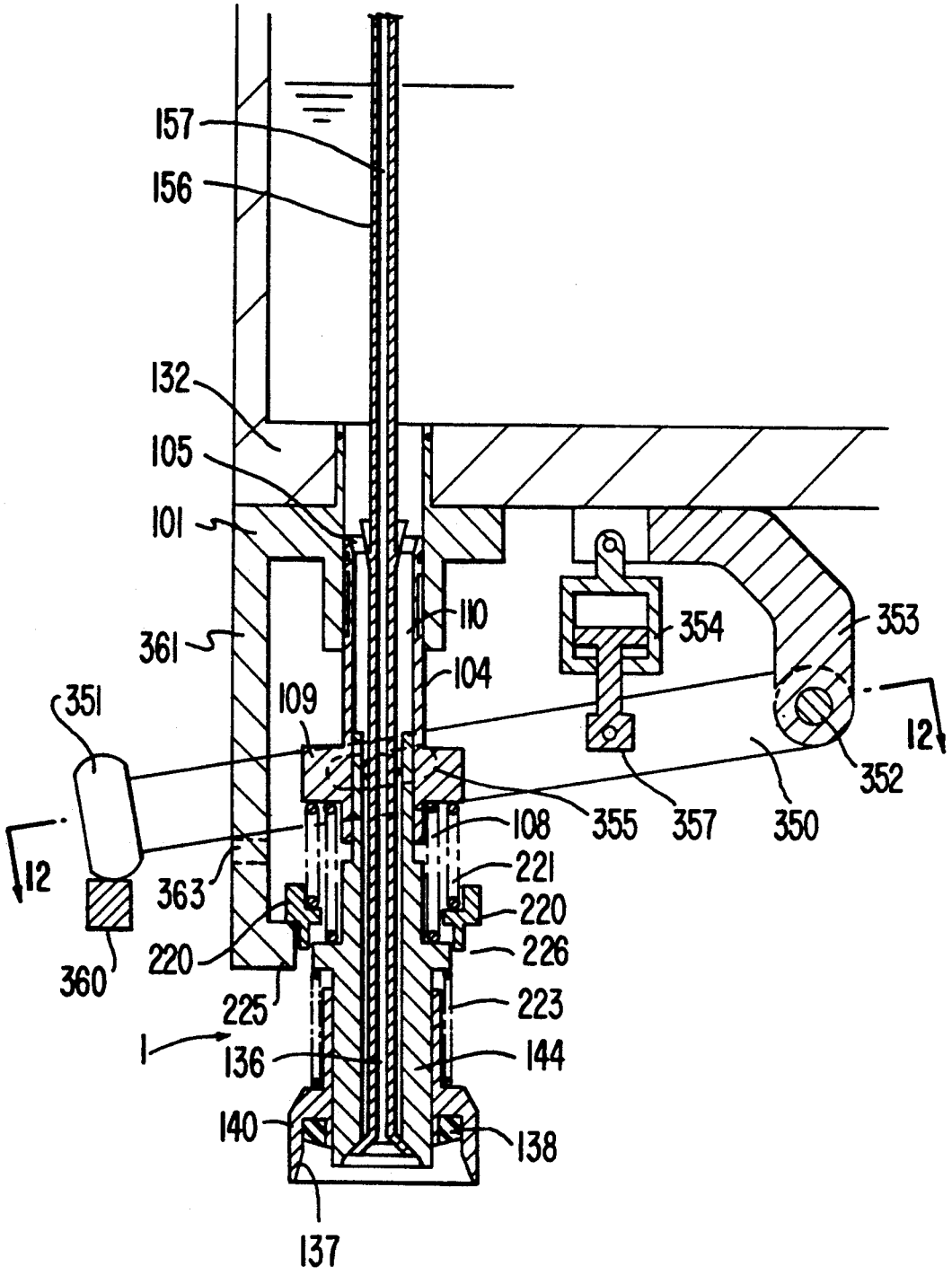
FIG. 9 is a vertical cross-sectional view of a modified form of the container filling apparatus employing different elevator means.

It is to be noted that because the gating valve would not assume the open condition even if the arm members 350 were in the lowered state shown in FIG. 4, the liquid would not flow out of the valve under the condition where containers are not present. In addition, by changing the third elastic body 223, the filling apparatus can be easily adapted to containers having various mechanical strengths, and the containers can be filled without being broken. Also, although the elastic body 354 was employed a biasing means for biasing the arm members 350 in the above-described preferred embodiment, the biasing means could be an air cylinder or the like which can vertically move the arm members 350 in correspondence with the control cam 360 as shown in FIG. 9. In addition, although the slidable engagements between the valve body 104, liquid valve seat 144 and bell-shaped member 140 effect seals therebetween, they can be made movable relative to one another by means of bellows in which sealing sections are separately formed.

Next, a second preferred embodiment of the present invention will be described with reference to FIGS. 10 to 14.

This second preferred embodiment is a container filling apparatus of a type that can easily change the net amount of the contents to fill a container.

Figure 10:
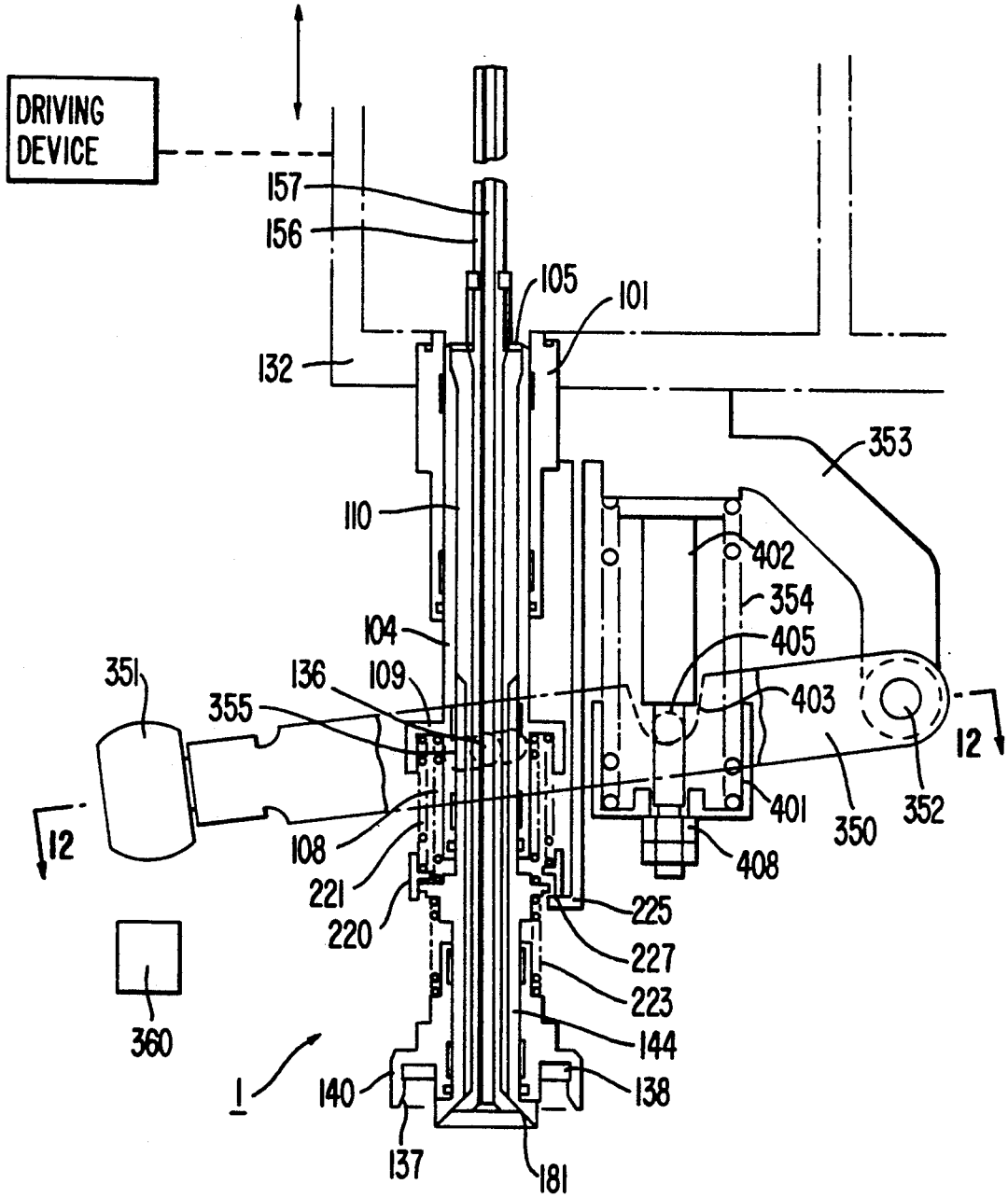
FIG. 10 is a vertical cross-sectional view of a second preferred embodiment of a container filling apparatus, according to the present invention, in a free condition in which an external force is not exerted.
Figure 11:
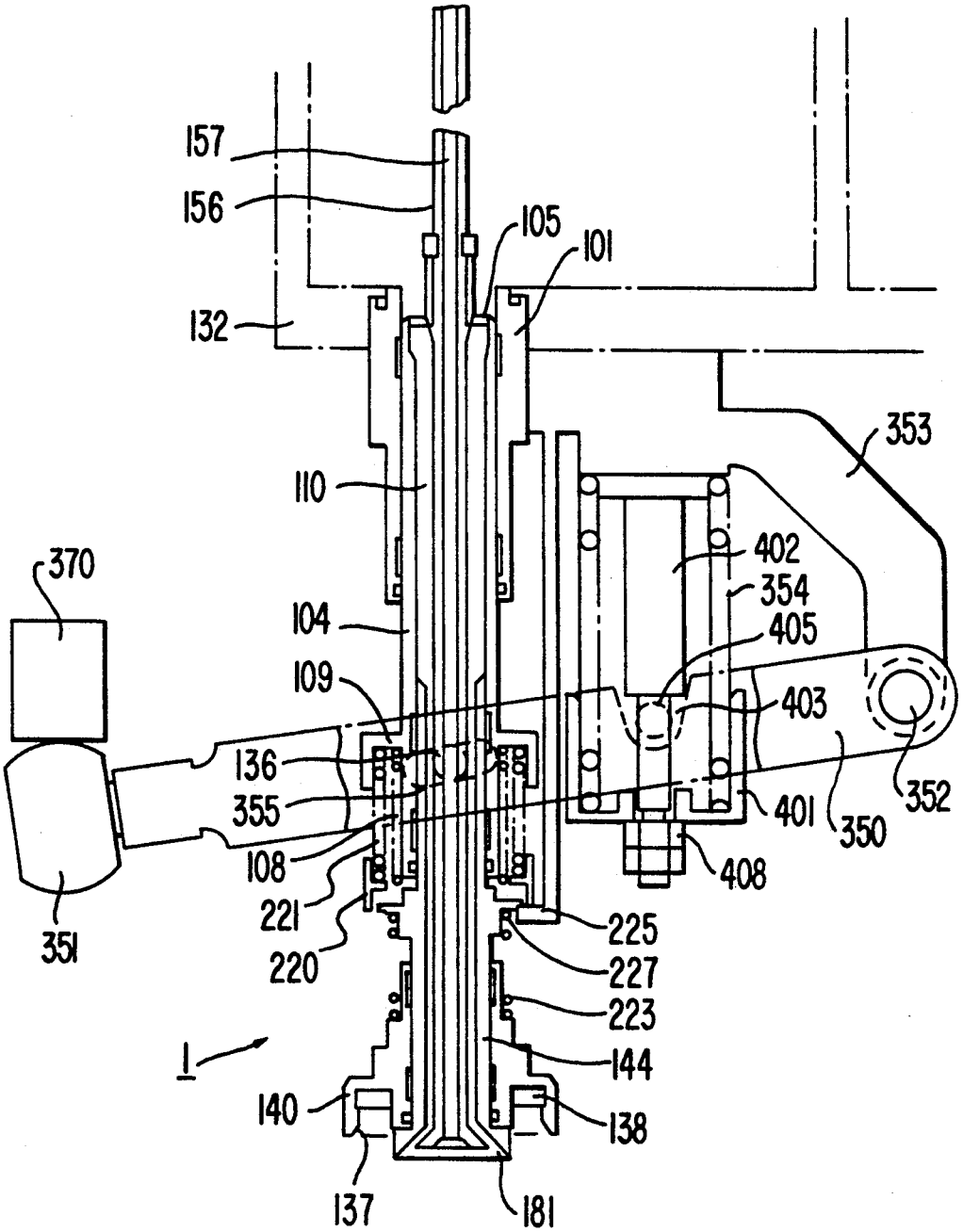
FIG. 11 is a vertical cross-sectional view of the same container filling apparatus in a liquid draining condition.

In FIGS. 10 and 11, reference numeral 1 designates a container filling apparatus, and numeral 132 designates an annular filler liquid tank which is provided with a driving device 100 capable of vertically moving the filler liquid tank 132 with respect to a container loading table. To the bottom of the same filler liquid tank 132 is fixedly secured a hollow housing 101 by means of bolts (not shown). Reference numeral 156 designates a vent tube defining a discharge path therein. The vent tube 156 is positioned at the center of the interior of the housing 101. The top end of the vent tube 156 is located in a gas layer of the filler liquid tank 132, and the bottom end of the vent tube 156 forms a tapered opening.

Reference numeral 104 designates a hollow valve body. The valve body 104 engages the housing 101 in a slidable manner (so as to be freely raised and lowered) as fitted along the inner circumferential surface of the housing 101. The interstice between the valve body 104 and housing 101 is sealed liquid-tight. The valve body 104 is integrally mounted to the vent tube 156 via a portion having a liquid passageway 105. And, the lower portion of valve body 104 forms a flange 109. Reference numeral 110 designates a liquid passageway formed between the valve body 104 and the vent tube 156.

Reference numeral 144 designates a hollow liquid valve seat. The upper outer circumferential surface of the liquid valve seat 144 is slidably fitted to the lower inner circumferential surface of the valve body 104, and the interstice between the liquid valve seat 144 and valve body 104 is sealed in a liquid-tight manner. Reference numeral 227 designates a central flange formed on the outer circumferential surface of the central portion (in the vertical direction) of the liquid valve seat 144. Between this central flange 226 and the flange 109 is interposed a first elastic body 108.

Figure 13:
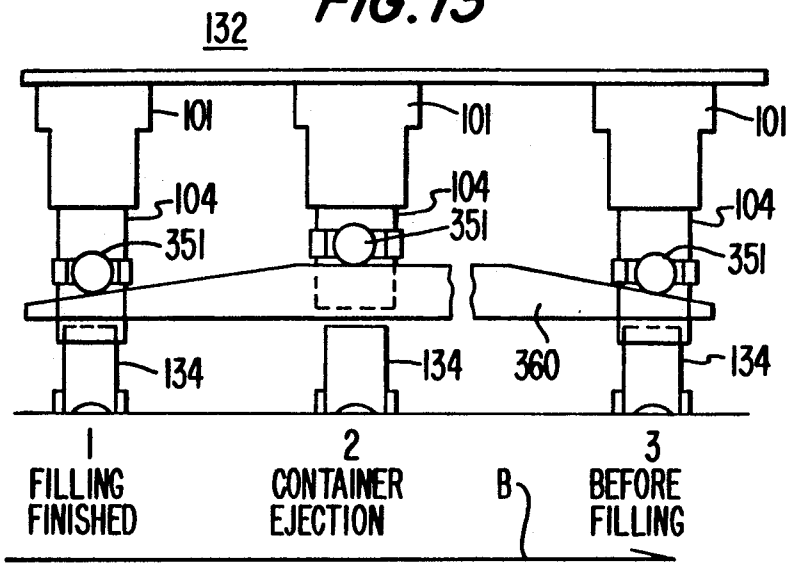
FIG. 13 is a schematic view showing successive filling steps carried out by the second preferred embodiment of the container filling apparatus according to the present invention.
Figure 12:
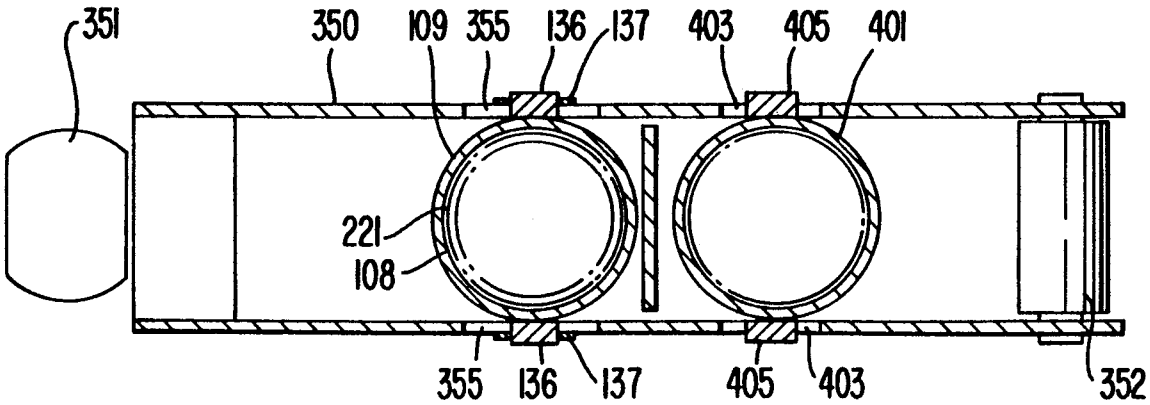
FIG. 12 is a horizontal cross-sectional view taken along line 12—12 in FIG. 10.

Reference numeral 140 designates a bell-shaped member, and this bell-shaped member 140 is slidably fitted around the outer circumferential surface of the lower portion of the liquid valve seat 144. The interstice between the bell-shaped member 140 and liquid valve seat 144 is sealed liquid-tightly by means of a seal member. It is to be noted that containers 134 in FIG. 13 are placed on a horizontal loading table (not shown) fixed with respect to a main body of a filling machine, and they are restrained by a semi-circular guide member having its center or curvature at the central portion of the filling apparatus 1.

Now, a filling valve elevator for vertically moving the valve body 104 will be described. Reference numerals 136 in FIGS. 10 to 12 designate pins provided on the outer side surface of the central portion of the valve body 104, and these pins 136 are slidably received in elongate holes 355 of arm members 350. At respective first end portions of the arm members 350 is mounted a roller 351, and at the other end portions of the same arm members 350 is mounted a pin 352. The arm members 350 are rotatably supported by the pin 352 and a support arm 353 fixedly secured to the bottom surface of the filler liquid tank 132. It is to be noted that to the pins 136 are mounted rotary lock plates 137 for preventing rotation of the valve body 104.

Reference numeral 402 designates a fixed support. This fixed support 402 is positioned between the elongate holes 355 of the arm members 350 and the pin 352. The fixed support 402 is fixedly secured to the bottom surface of the filler liquid tank 132 via the support arm 353. Reference numeral 408 designates a float stopper member mounted to the bottom end of a lower stem portion of the same fixed support 402. Numeral 401 designates a float mounted to the lower stem portion of the fixed support 402 in a vertically movable manner. Numeral 354 designates a fourth elastic body interposed between the float 401 and the support arm 353. The fourth elastic body 354 biases the float 401 downwardly. Numeral 403 designates a notch formed in the arm member, and numeral 405 designates an engagement shaft received within the same notch 403. The engagement shaft 405 is mounted to the lower stem portion of the fixed support 402.

Reference numeral 225 designates a stopper member. The stopper member 225 is positioned between the elongate holes 355 of the arm members 350 and the fixed support 402, and is fixed to the bottom surface of the filler liquid tank 132. Reference numeral 220 designates an intermediate spring bracket. The intermediate spring bracket 220 extends around the central flange 227 of the liquid valve seat 144 and is held in contact with the stopper member 225. Reference numeral 221 designates a second elastic body, which is interposed between the intermediate spring bracket 220 and the flange 109 at the lower portion of the valve body 104. Reference numeral 223 designates a third elastic body interposed between the central flange 227 of the liquid valve seat 144 and the bell-shaped member 140. The bell-shaped member 140 is thus biased downwards by this third elastic body 223.

Reference numeral 360 designates a control cam, which is held in contact with the above roller 351, and vertically moves the valve body 104 by making the arm members 350 swing up and down about the pin 352.

Next, the operation of the above-described container filling apparatus will be described with reference to FIGS. 13 and 14. As shown in FIG. 13, containers 134 are fed to the filling apparatus 1 as maintained at a constant level, and the containers 134 are filled in the sequence represented by arrow B in FIG. 13.

At position ① in FIG. 13 the filling process has been completed and a valve body 104 and a vent tube 156 are about to be raised. The valve body 104 moves upwards as controlled by the control cam 360, a roller 351 and arm members 350.

At position ② in FIG. 13 the valve body 104 has risen to the uppermost position thereof and the container 134 is about to be ejected.

At position ③ in FIG. 13 a container 134 externally fed to the filing apparatus 1 is ready to undergo a filling operation. The valve body 104 moves downwards as controlled by the control cam 360, the roller 351 and the arm members 350.

Figure 14E:
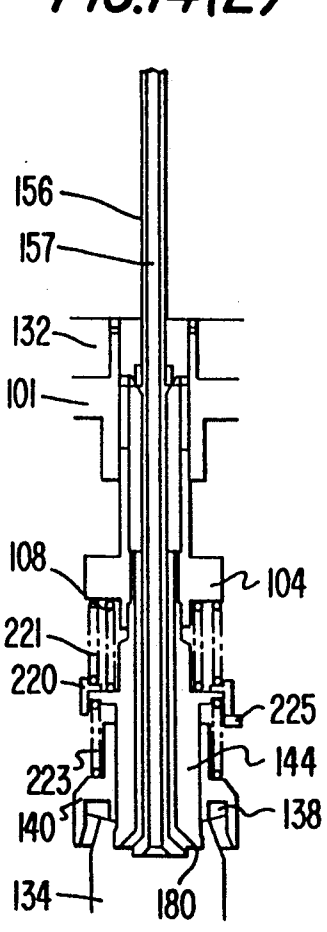
FIGS. 14(A)–14(E) are schematic views of the second preferred embodiment of the container filling apparatus showing successive steps of the filling process.
Figure 14D:
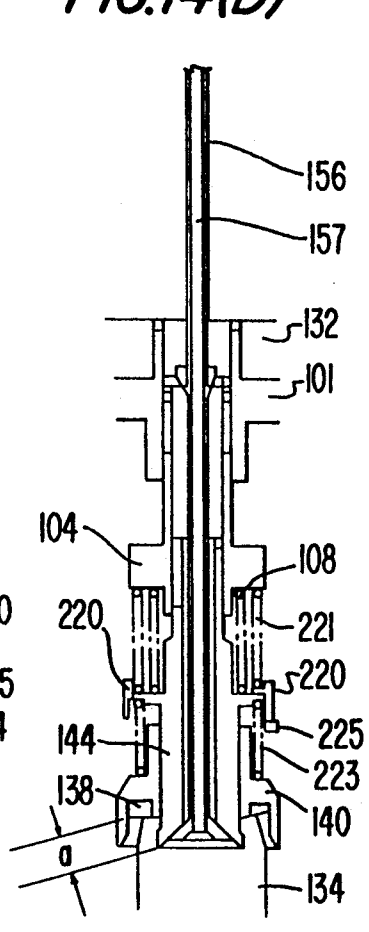
Figure 14C:
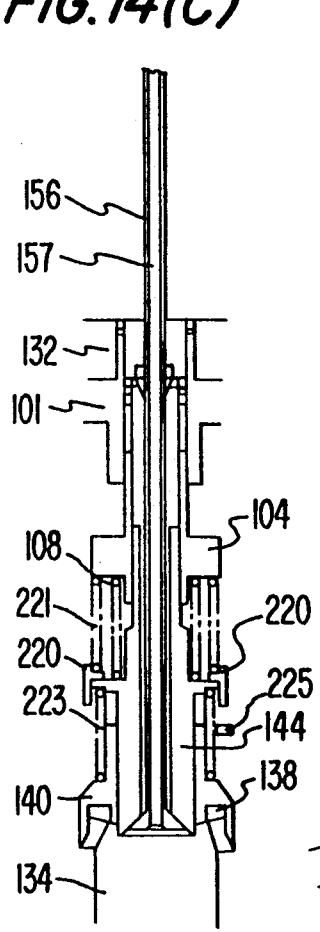
Figure 14B:
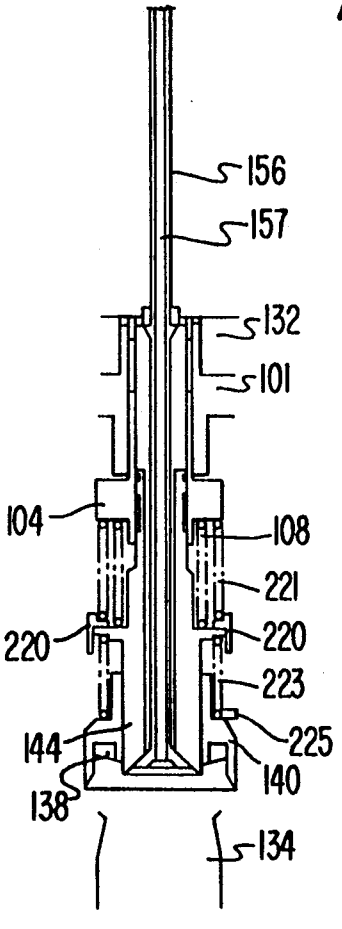
Figure 14A:
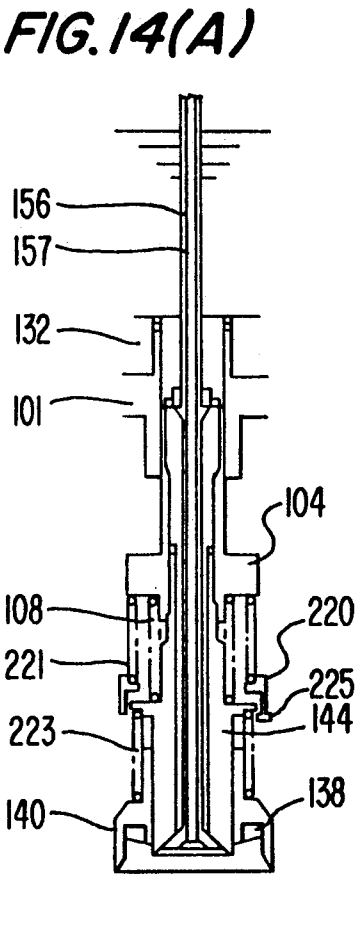

FIG. 14(A) shows the state where a container 134 is not present and the arm members 350 have been lowered up to the position shown in FIG. 10. At this time, the liquid valve 144 is biased downwards by the first elastic body 108 and butts against the bottom end portion of the vent tube 156, and the filling valve is held in a closed condition.

FIG. 14(B) shows the sate where, on the contrary, the arm members 350 are rising. When the apparatus shifts from the state shown in FIG. 14(A) to that shown in FIG. 14(B), since the engagement shaft 405 received in the notch 40 rises as the arm members 350 rise, the float 401 rises as separating from the float stopper member 408. The liquid valve seat 144 initially butts against the intermediate spring bracket 220 and thereafter it rises jointly with the intermediate spring bracket 220. In addition, even after the liquid valve seat 144 has butted against the intermediate spring bracket 220, due to the sum of the resilient forces of the first elastic body 108 and the second elastic body 221 the liquid valve seat 144 butts against the end portion of the vent tube 156, and the filling valve is held in a closed condition.

FIG. 14(C) shows a state at the moment when the arm members 350 are being lowered and the container 134 has butted against the seal member 138. At this time, due to the sum of the resilient forces of the first elastic body 108 and the second elastic body 221 the filling valve is also held in a closed condition.

FIG. 14(D) shows a state at the moment when the arm members 350 have been further lowered and the intermediate spring bracket 220 has butted against the stopper member 225. During the period when the apparatus shifts from the state shown in FIG. 14(C) to that shown in FIG. 14(C), since the sum of the resilient forces of the first elastic body 108 and the second elastic body 221 is larger than the resilient force of the third elastic body 223, the liquid valve seat 144 is urged against the end portion of the vent tube 156, and the filling valve is held in a closed condition.

Then the valve body 104, the vent tube 156 and the liquid valve seat 144 move downwards together with respect to the bell-shaped member 140 (the bell-shaped member is 140 is prevented from moving downwards by the container 134), and the third elastic body 223 is compressed. When the arm members 350 are lowered further starting from the state shown in FIG. 14(D), the intermediate spring bracket 220 butts against the stopper member 225, and is prevented from lowering further. Consequently, the resilient force of the second elastic body 223 does not act to lower the liquid valve seat 144. At this time, since the resilient force of the third elastic body 223 is larger than the resilient force of the first elastic body 108, downward movement of the liquid valve seat 144 stops.

On the other hand, since the vent tube 156 moves downwards, it is disengaged from the liquid valve seat 144, and a gap 180 is produced, whereby the filling valve assumes an opened condition. The lowering of the arm members 350 stops when the float 1 has butted against the float stopper member 408, and the state shown in FIG. 14(E) is realized.

As a result, the liquid in the filler liquid tank 132 flows along a path through the housing 101→the liquid passageway 105→the liquid passageway 110, and flows into the container 134. On the other hand, air within the container 134 is discharged to the gas layer in the filler liquid tank 132 through the discharge path 157 within the vent tube 156. Thus, a predetermined amount of liquid fills the container 134.

It is to be noted that the torque for rotating the arm members 350 downwards about the pin 352 generated by the resilient force of the elastic body 354 is larger than the torque for rotating the arm members 350 upwards about the pin 352 generated by the sum of the resilient forces of the second elastic body 221 and the first elastic body 108. Therefore, even in the case where a container 134 is present, it is possible for the arm members 350 to be lowered to a position at which the float 401 butts against the float stopper member 408.

Filling has completed with the apparatus is in the position (1) shown in FIG. 13. Starting from this state, the arm members 350 are raised by the control cam 360 and the roller 351. In accordance with the raising of the arm members 350, the valve body 104 a well a the vent tube 156 that is integral with the valve body 104 rise. However, because the resilient force of the third elastic body 223 is larger than the resilient force of the first elastic body 108, the intermediate spring bracket 220, the liquid valve seat 144 and the bell-shaped member 140 do not move.

Then, the tip end portion of the vent tube 156 butts against the liquid valve seat 144, resulting in a closed condition of the filling valve, and the apparatus returns to the state shown in FIG. 14(D). If the arm members 350 rise further, since the sum of the resilient forces of the first elastic body 108 and the second elastic body 221 is larger than the resilient force of the third elastic body 223, the intermediate spring bracket 220, the liquid valve seat 144 and the vent tube 156 move upwards together. At this time, the liquid valve seat 144 rises with respect to the bell-shaped member 140. After the seal member 138 is disengaged from the container 134 (See FIG. 14(C)), the apparatus assumes position (2) shown in FIG. 13, that is, the state shown in FIG. 14(B).

Next, the adjustment of a net content depth will be described. The net content depth is determined by a distance a between the lower end position of the liquid valve seat 144 and the upper end position of the container 134 butting against the seal member 138 as shown in FIG. 14(D). More particularly, when filler liquid is poured into the container 134, while air within the container 134 is discharged through the vent tube 156 into the gas layer in the filler liquid tank 132, the air in that portion of the container corresponding to distance a shown in FIG. 14(D) cannot escape. Hence, the distance a determines the net content depth. Therefore, the net content depth can be adjusted by changing the height of the filler liquid tank 132 by means of a driving device for vertically moving the filler liquid tank 132.

When the container 134 is not present, the vent tube 156 is moved downwards with respect to the liquid valve seat 144, whereby filler liquid stagnating in the liquid passageway 110 is discharged. FIG. 10 shows the same state shown in FIG. 14(A), where a container 134 is not present. Also, this figure shows the roller 351 under a free condition in which it is not held in contact with the control cam 360 or a cam 370.

Under this condition, the intermediate spring bracket 220 contacts the stopper member 225. Consequently, the arm members 350 are biased upwards by the second elastic body 221 via the flange 109 and the pins 136. Also, the same arm members 350 are biased downwards by the fourth elastic body 354 via the float 401, and the engagement shaft 405 received in the notches 403.

The resilient forces of the fourth elastic body and second elastic body 221 are such that under the above-mentioned condition, the torque biasing the arm members 350 downwards as produced by the fourth elastic member 354 is larger than the torque biasing the arm members 350 upwards as produced by the second elastic member 221. Therefore, the engagement shaft 405 butts against arm members 350 within the notches 403 and the float 401 butts against the float stopper member 408. Under this condition, the central flange 227 is not held in contact with the stopper member 225 or the intermediate spring bracket 220.

It is to be noted that in FIG. 10, the liquid valve seat 144 is biased downwards by the first elastic body 108, the liquid valve seat 144 butts against the end portion of the vent tube 156 to seal the latter, and the liquid passageway gating section 181 is held in a closed condition.

FIG. 11 shows a liquid draining condition in which a container 134 is not present but the vent tube 156 is lowered with respect to the liquid valve seat 144. The liquid passageway gating section 181 is held in an opened condition, and thus the liquid stagnating in the liquid passageway 110 is discharged.

This liquid draining condition can be realized by depressing the roller 351 of the valve elevator, once it is in the free condition shown in FIG. 10, by means of a cam 370 or the like.

As the roller 351 of the valve elevator is being depressed, the arm members 350 swing downwards about the pin 352, and the arm members 350 move out of engagement with the engagement shaft 405. At the same time, the pins 136 are pushed downwards and consequently, the valve body 104 to which the pin shafts 136 are fixed and the vent tube 156 move downwards while compressing the second elastic body 221. In addition, under the action of the first elastic body 108, the liquid valve 104 abutting against the end portion of the vent tube 156 also moves downwards.

When the roller 351 is further depressed downwards, the central flange 227 of the liquid valve seat 144 comes into contact with the stopper member 225. Thereafter the downward movement of the liquid valve seat 144 stops, and the vent tube 156 further moves downwards while compressing the first elastic body 108. Consequently, the liquid passageway gating section 181 opens, and the liquid stagnating in the liquid passageway 110 is discharged.

Once the liquid passageway gating section 181 has opened, the downward movement of the roller 351 caused by the cam 370 or the like is stopped. Therefore, the liquid passageway gating section 181 is held in the opened condition.

In order to bring the liquid passageway gating section 181 into the closed condition again, it is only necessary to relieve the force depressing the roller 351 downwards. More particularly, starting from the condition shown in FIG. 11, as the force depressing the roller 351 downwards is released, the valve body 104, the pins 136, the arm members 350 and the vent tube 156 are moved upwards by the resilient forces of the first elastic body 108 and the second elastic body 221. At this time, the central flange 227 is urged against the stopper member 225 by the resilient force of the first elastic body 108, and the liquid valve seat 144 is held stopped.

If the force depressing the roller 351 is further relieved, the end portion of the vent tube 156 butts against the liquid valve seat 144, resulting in a closed condition of the liquid passageway gating section 181. Thereafter, the liquid valve seat 144 and the vent tube 156 rise together, and the central flange 227 leaves the stopper member 225.

The rising motion of the vent tube 156 stops when the engagement shaft 405 is seated within the notches 403 whereby the raising of the arm members 350 stops. At this time, if the force depressing the roller 351 is completely removed, and the free condition shown in FIG. 10 is realized, the positions of the arm members 350, the vent tube 156 and the other members do not change, and the closed condition of the liquid passageway gating section 181 is maintained.

Next, a third preferred embodiment of the present invention will be described with reference to FIGS. 15 and 16. This third preferred embodiment is not a container filling apparatus of the type in which a net content depth can be easily changed as is the case with the above-described second preferred embodiment. Moreover, a liquid valve seat 154 shown in FIGS. 15 and 16 is employed in place of the liquid valve seat 144 and the bell-shaped member 140 shown in FIG. 10.

Figure 15:
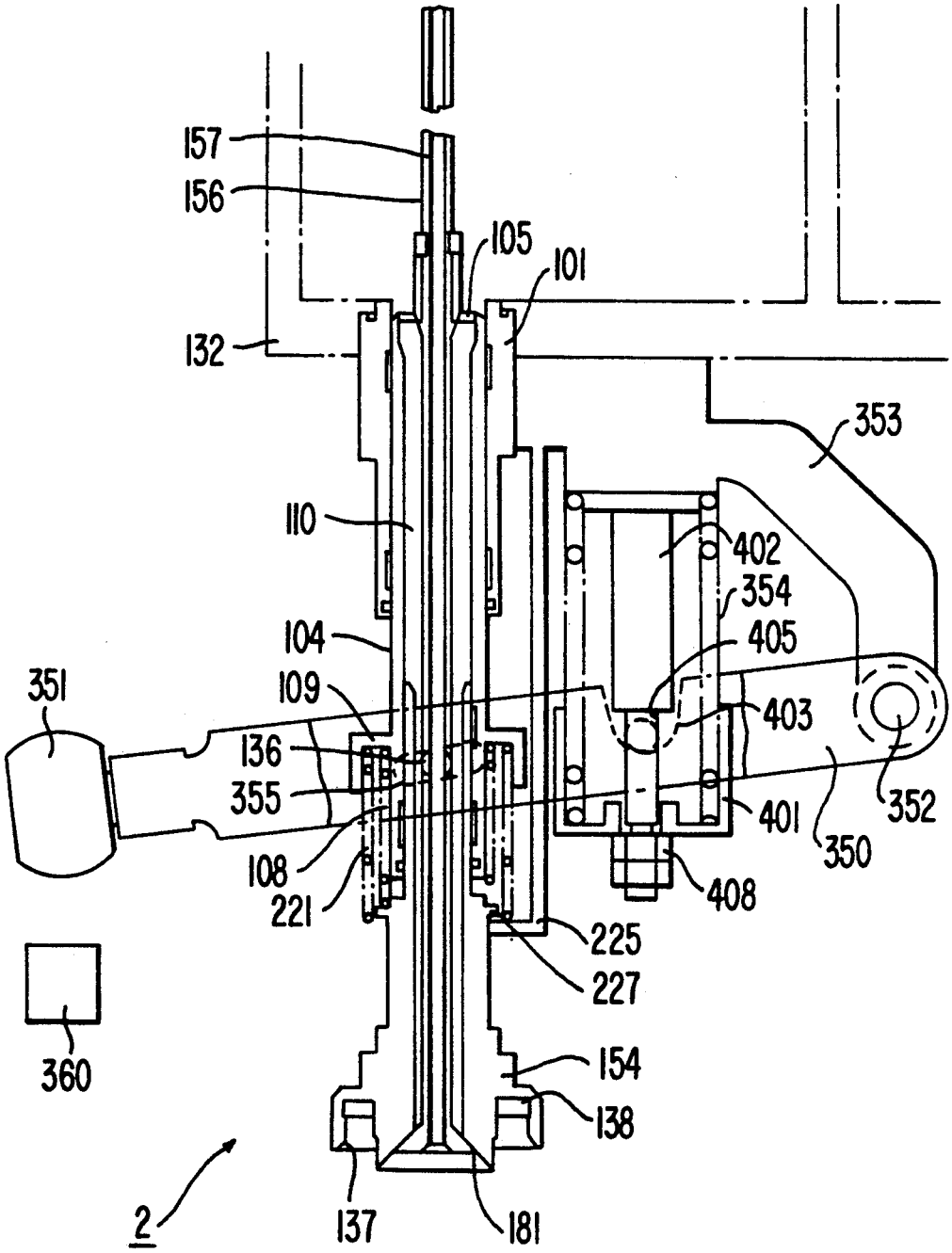
FIG. 15 is a vertical cross-sectional view of a third preferred embodiment of a container filling apparatus, according to the present invention, in a free condition in which an external force is not exerted.
Figure 16:
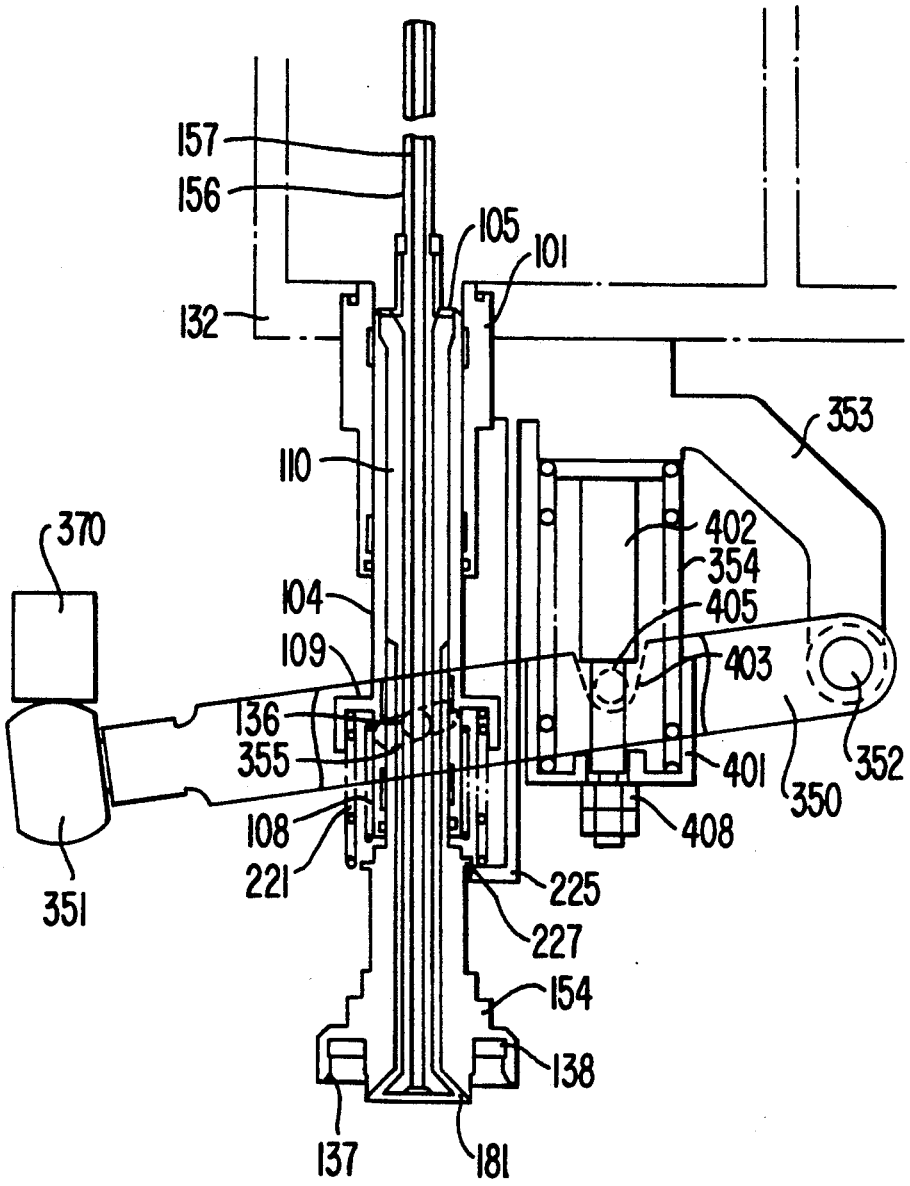
FIG. 16 is a vertical cross-sectional view of the same container filling apparatus in a liquid draining condition.

As shown in FIG. 15, a second elastic body 221 is provided between a flange 109 and a stopper member 225. Also, in this embodiment, downward movement of a central flange 226 of the liquid valve seat 154 can be stopped by the stopper member 225.

Similarly to the second preferred embodiment, in this third preferred embodiment when a roller 351 is depressed under the condition in which a container 134 is not present, a vent tube 156 is moved downwards with respect to the liquid valve seat 154 and filling liquid stagnating in the liquid passageway gating section 181 is discharged.

It is to be noted that FIG. 15 shows a free condition in which a container 134 is not present, neither the control cam 360 nor the cam 370 act upon the roller 351, and the liquid passageway gating section 181 is held closed.

FIG. 16 shows a liquid draining state in which a container 134 is not present, the vent tube 156 is displaced relative to the liquid valve seat 154, whereby the liquid passageway gating section 181 is held opened, and filling liquid stagnating in the liquid passage will be discharged.

As will be apparent from the detailed description of preferred embodiments of the present invention above, according to the present invention, by adjustably moving at least one of a filler liquid tank or a stopper member, a net content depth can be easily adjusted for a large number of installed filling apparatuses.

In addition, even in the case where no container is present, the gating valve will not open. Moreover, since the apparatus can be adapted to a mechanical strength of a container by selecting elastic bodies exerting appropriate biasing forces, containers can be filled without being broken.

Furthermore, the container filling apparatus according to the present invention has an advantage of being able to lower a valve body with an external force to open a flow passageway gating section so that liquid stagnating within a liquid passageway of a filling valve can be discharged.

While a principle of the present invention has been described above in connection with a number of preferred embodiments of the invention, it is intended that all matter contained in the description and illustrated in the accompanying drawings be interpreted as illustrative of and not as a limitation on the scope of the invention.

We claim:

1. A container filling apparatus, comprising:

a tank for accommodating liquid to fill a container;

a hollow housing communicating with said tank and fixedly secured to the bottom of said tank;

a vent tube extending through said housing;

a valve body supported so as to be movable relative to said housing, having a passageway therein through which liquid in said tank will flow, and fixedly secured to said vent tube;

a valve seat supported so as to be movable relative to the valve body, a liquid passageway being defined between said valve seat and the outer surface of said vent tube, and said valve seat being movable into abutment against the end portion of the vent tube to form a gating valve therewith;

a first resilient body operatively associated with said valve seat and said valve body so as to bias said valve seat and said valve body in opposite directions;

a bell-shaped member supported so as to be movable relative to said valve seat, and having a container seal member which is to establish a seal between said bell-shaped member and a container to be filled;

a third resilient body operatively associated with said valve seat and said bell-shaped member so as to bias said valve seat and said bell-shaped member in opposite directions;

an intermediate spring bracket;

a second resilient body operatively associated with said intermediate spring bracket and said valve body so as to exert a force acting therebetween in a direction that biases said valve body upwardly;

an elevator operatively connected to said valve body and which elevator elevates, lowers and downwardly biases the valve body during a filling operation of the apparatus;

a stopper member located at such a position in the apparatus as to engage said intermediate spring bracket and thereby limit movement thereof; and driving means for vertically moving at least one of said tank and said stopper member.

2. A container filling apparatus as claimed in claim 1, wherein said elevator comprises an arm pivotably mounted to said tank, a pin connecting said arm to the valve body, and a cam in operative camming engagement with said arm member.

3. A container filling apparatus as claimed in claim 1, wherein said elevator comprises a fourth resilient body for downwardly biasing said valve body;

a float mounted to the bottom portion of said fourth resilient body; and a float stopper member for restricting a lowered position of said float.

4. A container filling apparatus as claimed in claim 1, wherein the apparatus is constructed in such manner that a liquid passageway gating section can be opened by lowering the valve body and the vent tube with an external force, even if the container is not present.

5. A container filler apparatus as claimed in claim 1, wherein said valve body and said housing have respective peripheral surfaces in sliding engagement with one another, said valve seat and said valve body have respective peripheral surfaces in sliding engagement with one another, and said bell-shaped member and said valve seat have respective peripheral surfaces in sliding engagement with one another.

6. A container filler apparatus as claimed in claim 1, wherein each of said resilient bodies is a coil spring.

* * * * *